US007258460B2

(12) United States Patent
Jones et al.

(10) Patent No.: US 7,258,460 B2
(45) Date of Patent: Aug. 21, 2007

(54) LIGHTED BENCH

(75) Inventors: Chad H. Jones, Frisco, TX (US); Scott A. Plasek, Irving, TX (US); Gustav P. Kuelbs, Grapevine, TX (US)

(73) Assignee: World Factory, Inc., Coppell, TX (US)

( * ) Notice: Subject to any disclaimer, the term of this patent is extended or adjusted under 35 U.S.C. 154(b) by 0 days.

(21) Appl. No.: 11/205,819

(22) Filed: Aug. 17, 2005

(65) Prior Publication Data

US 2006/0039135 A1 Feb. 23, 2006

Related U.S. Application Data

(60) Provisional application No. 60/690,547, filed on Jun. 14, 2005, provisional application No. 60/603,192, filed on Aug. 20, 2004.

(51) Int. Cl.
*F21W 131/10* (2006.01)

(52) U.S. Cl. ..... 362/131; 362/253

(58) Field of Classification Search ..... 362/253, 362/127, 131, 134
See application file for complete search history.

(56) References Cited

U.S. PATENT DOCUMENTS

| | | | | |
|---|---|---|---|---|
| 3,729,627 | A * | 4/1973 | Littell | 362/131 |
| 4,232,357 | A * | 11/1980 | Dietz | 362/486 |
| 5,107,637 | A * | 4/1992 | Robbins | 52/28 |
| 5,329,716 | A * | 7/1994 | Fite | 40/575 |
| 6,116,748 | A * | 9/2000 | George | 362/145 |
| 6,561,684 | B2 * | 5/2003 | Reitze et al. | 362/488 |
| 6,854,869 | B1 * | 2/2005 | Fernandez | 362/488 |

* cited by examiner

*Primary Examiner*—Laura K. Tso
(74) *Attorney, Agent, or Firm*—James E. Walton

(57) ABSTRACT

A safer and more decorative bench system comprising a plurality of ends, a seat supported by the ends, and a lighting system for providing illumination is provided.

20 Claims, 17 Drawing Sheets

LIGHTED BENCH

This application claims the benefit of U.S. Provisional Application No. 60/603,192, filed 20 Aug. 2004, titled "Lighted Bench" and U.S. Provisional Application No. 60/690,547, filed 14 Jun. 2005, titled "Lighted Bench."

BACKGROUND OF THE INVENTION

1. Field of the Invention

The present invention relates in general to the field of benches.

2. Description of Related Art

There are many designs of benches well known in the art. However, there remains room for improvement upon current bench designs. For example, some benches are used outdoors at night or in otherwise poorly illuminated spaces where the user of the bench may not be able to visually inspect the bench before sitting on the bench. Also, some benches have decorative elements. In poorly lit conditions, the decorative elements are not fully appreciated. While there are many benches well known in the art, considerable room for improvement remains.

SUMMARY OF THE INVENTION

There is a need for a safer and more decorative bench.

Therefore, it is an object of the present invention to provide a safer and more decorative bench, having features allowing the user to easily implement and utilize the system and method.

This object is achieved by providing a safer and more decorative bench which allows the user to easily implement and utilize the system and method.

The present invention provides significant advantages, including: (1) allowing visual inspection of the bench when the bench is located in a poorly illuminated space thereby reducing the risk of physical injury related to using the bench, such as sitting on a defective or littered bench; and (2) illuminating decorative elements of the bench.

Further objects and advantages of this invention will become apparent from a consideration of the drawings and ensuing description.

BRIEF DESCRIPTION OF THE DRAWINGS

For a more complete understanding of the present invention, including its features and advantages, reference is now made to the detailed description of the invention taken in conjunction with the accompanying drawings in which like numerals identify like parts, and in which.

DETAILED DESCRIPTION OF THE PREFERRED EMBODIMENT

The present invention represents the discovery that a seating apparatus such as a bench, chair, swing, glider, rocker, or other seating apparatus may be illuminated by use of a lighting system which is at least optionally and/or partially solar powered. The present invention further represents the discovery that a seating apparatus may carry graphical indicia such as commercial advertisements, artwork, or other graphical indicia and that the graphical indicia may be illuminated by use of a solar powered lighting system which is at least optionally and/or partially solar powered.

Figure 1B:
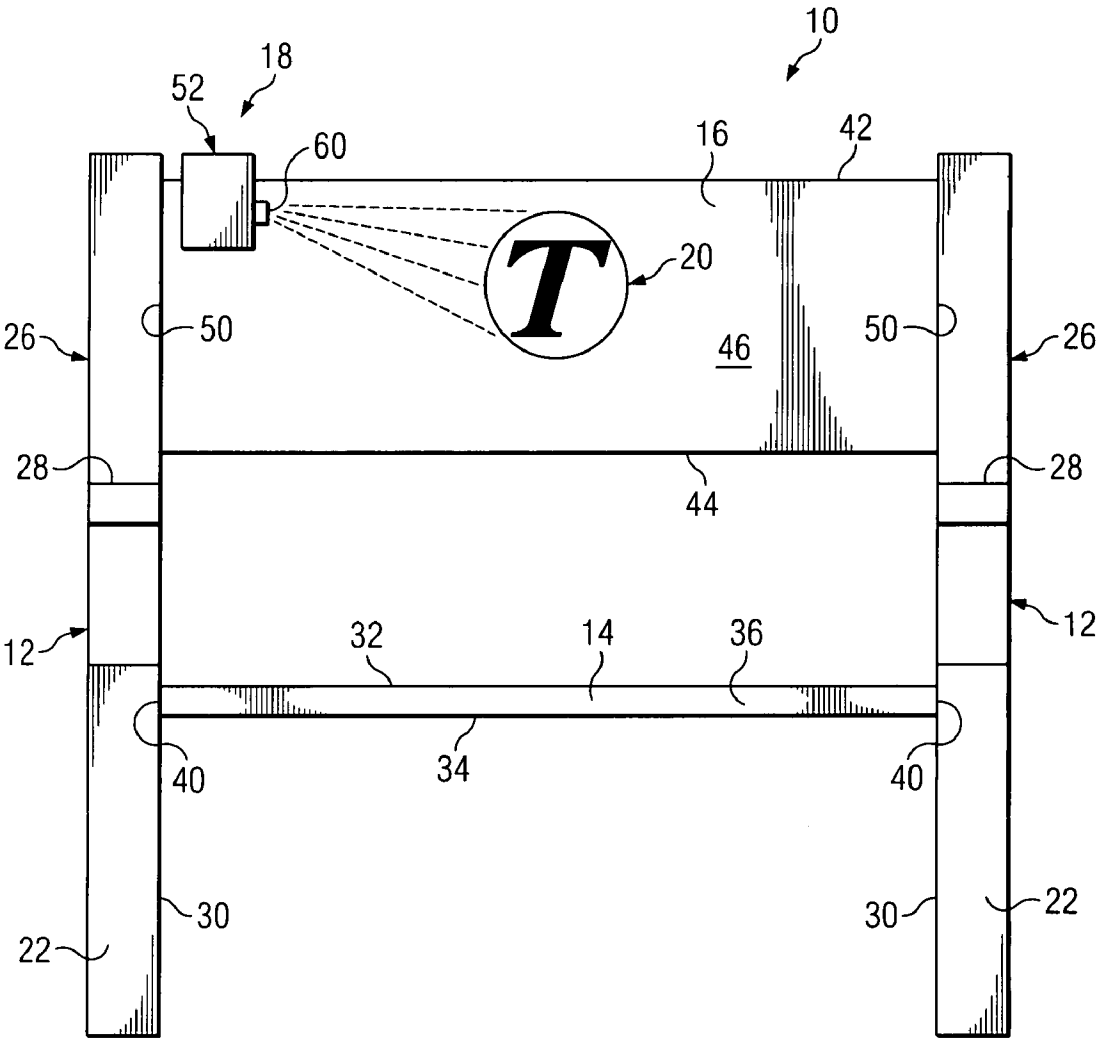
FIG. 1B is a front view of the bench system of FIG. 1A.
Figure 1A:
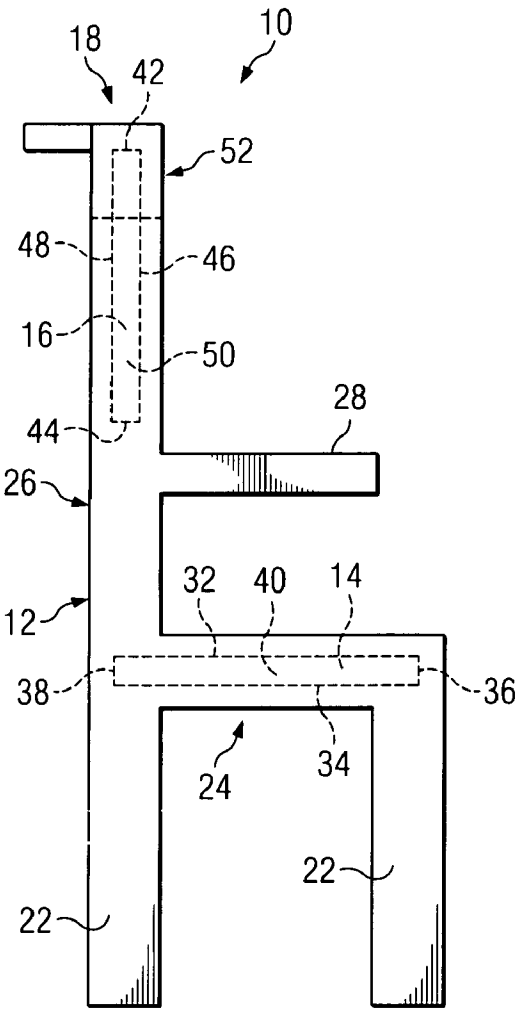
FIG. 1A is a side view of a bench system according to the present invention.
Figure 2:
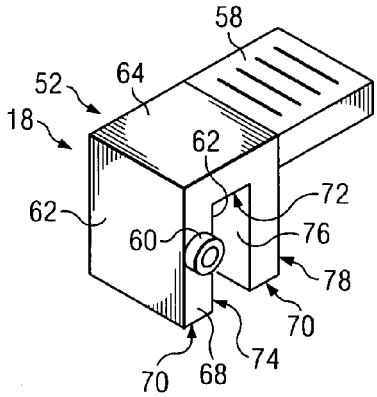
FIG. 2 is a perspective view of a portion of the bench system of FIG. 1A.

Referring now to FIGS. 1A-2 in the drawings, the preferred embodiment of a bench system 10 according to the present invention is illustrated. Bench system 10 preferably comprises a plurality of end portions 12, at least one seat portion 14, at least one optional back rest member 16, and at least one lighting system 18. In addition, bench system 10 may include at least one decoration 20. End 12 comprises a plurality of legs 22, a horizontal portion 24, a generally vertical portion 26, an arm rest 28, and an inner side 30. Seat 14 comprises a seat top 32, a seat bottom 34, a seat front 36, a seat back 38, and a plurality of seat ends 40. Back rest 16 comprises a back rest top 42, a back rest bottom 44, a back rest front 46, a back rest back 48, and a plurality of back rest ends 50. End 12 is substantially "h" shaped with the additional horizontal extension of arm rest 28 from vertical portion 26. Arm rest 28 is positioned such that arm rest 28 is aligned with horizontal portion 24. Seat 14 and back rest 16 are substantially rectangular in shape as viewed from all plan views. However, the shape of seat 14 and back rest 16 may alternately be any other desirable shape.

Lighting system 18 is preferably substantially housed within an enclosure 52; however, it will be appreciated that in some embodiments of the present invention, one or more components of lighting system 18 may be located remote from enclosure 52. Lighting system 18 preferably comprises a rechargeable power system (not shown), at least one power storage system (not shown), at least one electrical connector (not shown), and at least one lighting element 60. Rechargeable power system preferably comprises a solar recharging system (not shown) for converting solar energy into electrical energy. Solar recharging system preferably comprises a solar collector 58 for receiving solar energy. Solar collector 58 may be located at any suitable location on or about bench system 10; however, it is preferred that solar collector 58 be optimally exposed to solar light. Solar collector 58 is preferably attached to enclosure 52, but may alternately be located remote from enclosure 52 and be connected to rechargeable power system 54 by electrical connectors 56 (see FIGS. 3A and 3B).

The power storage system preferably comprises at least one rechargeable battery (not shown). However, the power storage system may alternately comprise at least one capacitor or other device for storing electrical power. The rechargeable power system, the power storage system, and lighting element 60 are electrically connected by electrical connectors 56. Electrical connectors 56 are preferably electrically insulated copper wires but may alternately be any other suitable apparatus for conducting electricity.

In operation, the solar recharging system recharges the rechargeable battery of the power storage system. The power storage system transfers electrical energy through electrical connectors 56 to lighting element 60 where the electrical energy is converted into light energy. Lighting element 60 is preferably a light emitting diode, but may alternately be an incandescent bulb, cold cathode ray tube, fluorescent, or any other suitable electrical lighting apparatus.

The rechargeable power system may be recharged by means other than the solar recharging system. For example, the rechargeable power system may alternately comprise a rechargeable battery pack in which the battery pack is removed from lighting system 18, recharged remotely from lighting system 18, and thereafter replaced into lighting system 18 to again supply electrical energy to lighting element 60. Of course, the foregoing configuration allows for the interchanging, or swapping, of battery packs. Also, the rechargeable power system may accept externally supplied alternating current (AC) from a conventional AC outlet to recharge the rechargeable battery of the power storage system or to simultaneously recharge the rechargeable battery and power the lighting element 60.

Alternate embodiments of lighting system 18 may not include the rechargeable power system. Instead, lighting system 18 may include a circuit for powering lighting element 60 which can only operate with externally supplied electrical energy, either AC or disposable batteries.

Enclosure 52 comprises an enclosure front 62, an enclosure top 64, an enclosure left side 66, an enclosure right side 68, at least one enclosure bottom side 70, an enclosure inner top face 72, an enclosure inner front face 74, an enclosure inner rear face 76, and an enclosure rear face 78. Enclosure 52 is substantially an upside down "U" shape as viewed from either enclosure right side 68 or enclosure left side 66. Solar collector 58 is preferably attached to enclosure rear face 78 substantially at the interface of enclosure rear face 78 and enclosure top 64. Lighting element 60 is attached to enclosure right side 68. An alternate embodiment of bench system 10 may comprise multiple lighting elements 60 with such lighting elements 60 being located anywhere on or about bench system 10.

As assembled, inner side 30 along horizontal portion 24 of a first end 12 is preferably attached to a seat end 40 while a back rest end 50 is attached to the same inner side 30 along the vertical portion 26 of the first end 12. Simultaneously, inner side 30 along the horizontal portion 24 of a second end 12 is attached to the other seat end 40 while the other back rest end 50 is attached to the same inner side 30 along the vertical portion of the second end 12. Seat 14 and back rest 16 are preferably made of wood but may alternately be made of metal, plastic, or any other appropriate material. Seat 14 and back rest 16 may alternately comprise a plurality of slats instead of the single slat as shown in the preferred embodiment. Ends 12 are preferably made of metal, but may alternately be made of plastic, wood, or any other appropriate material.

Decoration 20 is preferably carried by back rest front 46 in a position substantially centered between back rest ends 50 and also substantially centered between back rest top 42 and back rest bottom 44. Decoration 20 is preferably made of metal and recessed into back rest 16. However, decoration 20 may alternately be made of plastic, glass, wood, or any other suitable material, and may be integral or formed into back rest 16. Also, decoration 20 may alternately be painted, printed, or otherwise marked onto back rest front 46. Decoration 20 may alternately be located anywhere on, about, or attached to bench system 10. Decoration 20 preferably displays alphanumeric indicia but may alternately display a portrait, picture, or any other decorative design.

Enclosure 52 is preferably removably attached to back rest 16 in a manner such that enclosure inner top face 72 interfaces with back rest top 42, back rest front 46 interfaces with enclosure inner front face 74, and back rest back 48 interfaces with enclosure inner rear face 76.

Lighting element 60 is preferably attached to enclosure right side 68 in a manner such that light emitted from lighting element 60 is substantially directed toward decoration 20. However, lighting element 60 may alternately be attached to bench system 10 in any manner suitable for illuminating any portion or combination of portions of bench system 10 or for illuminating the area around or about bench system 10.

Figure 3A:
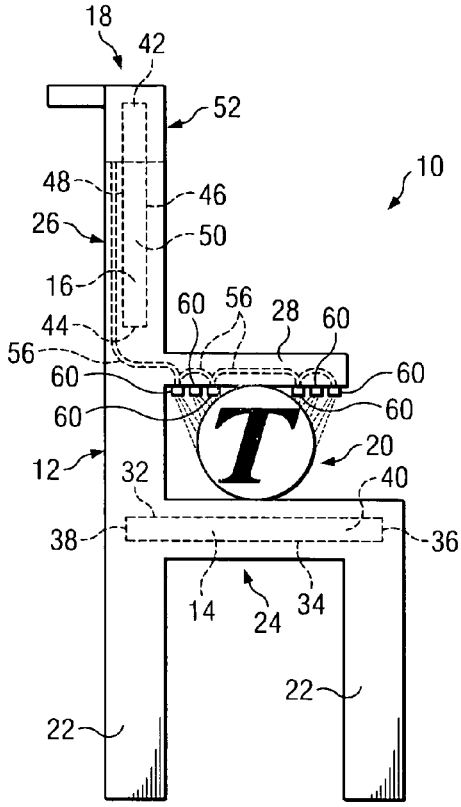
FIG. 3A is a side view of a bench system according to an alternate embodiment of the present invention.
Figure 4A:
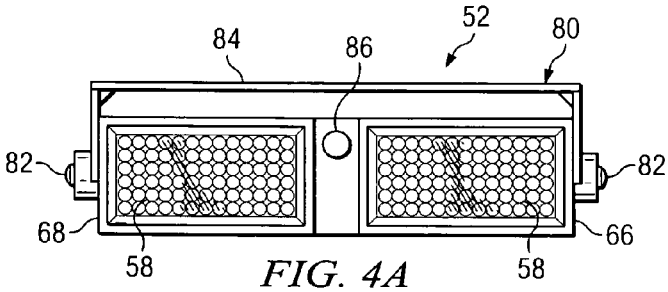
FIG. 4A is a top view of a portion of the bench system according to an alternate embodiment of the present invention.
Figure 4C:
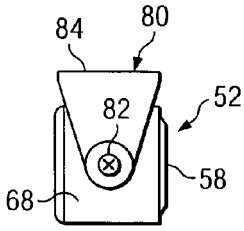
FIG. 4C is a side view of the bench system of FIG. 4A.
Figure 4B:
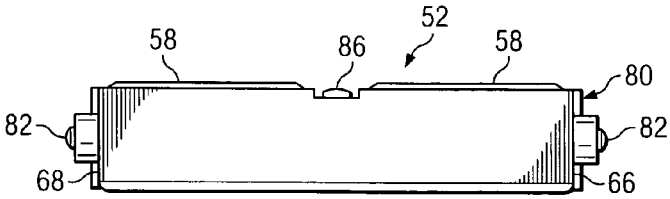
FIG. 4B is a rear view of the bench system of FIG. 4A.
Figure 3B:
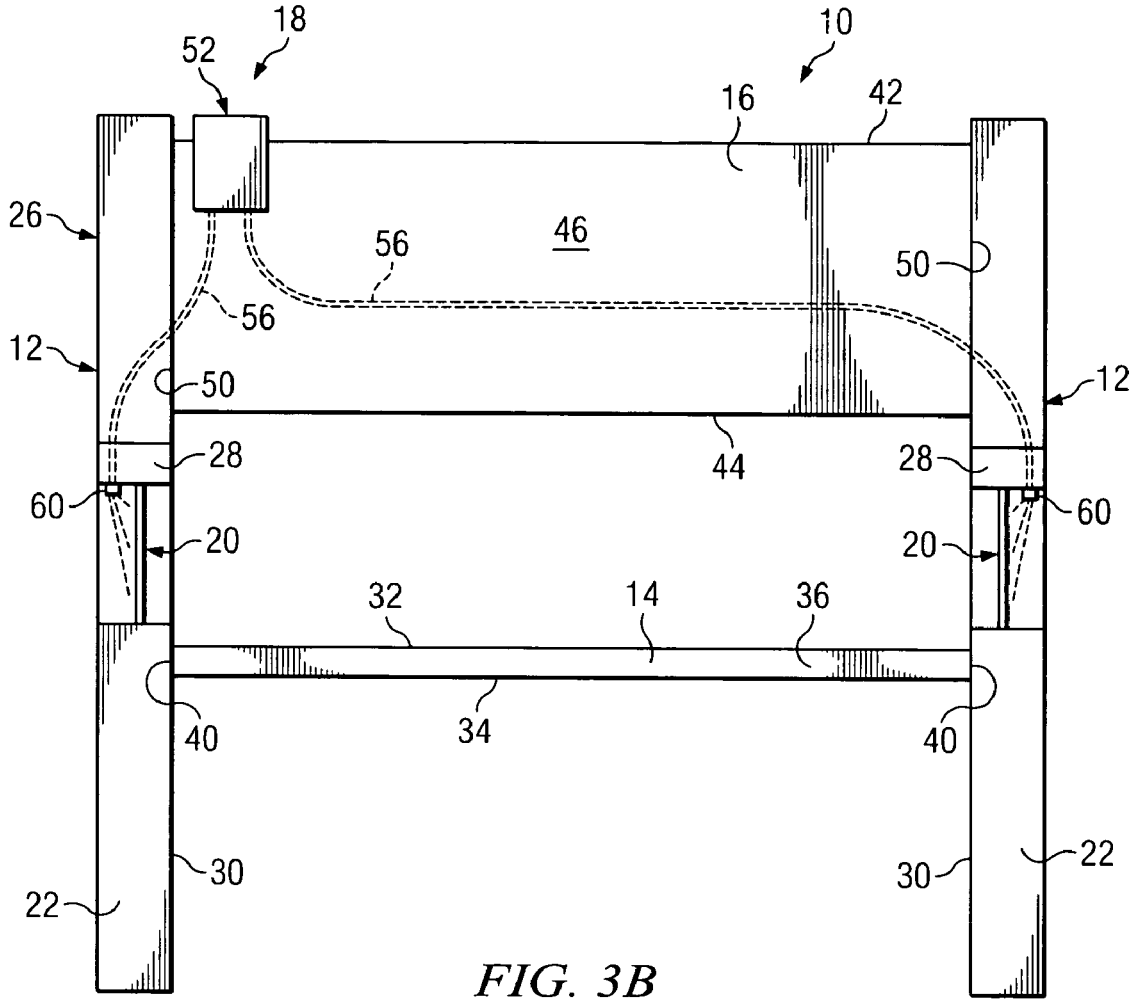
FIG. 3B is a front view of the bench system of FIG. 3A.
Figure 4D:
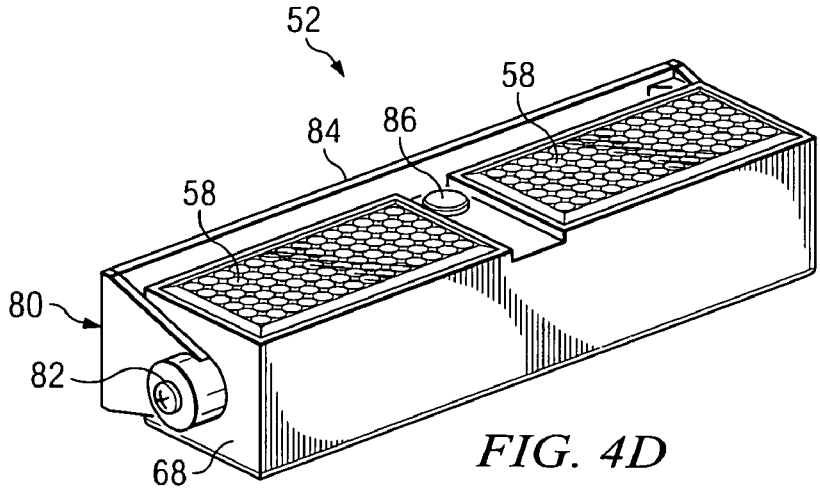
FIG. 4D is a perspective view of the bench system of FIG. 4A.
Figure 4E:
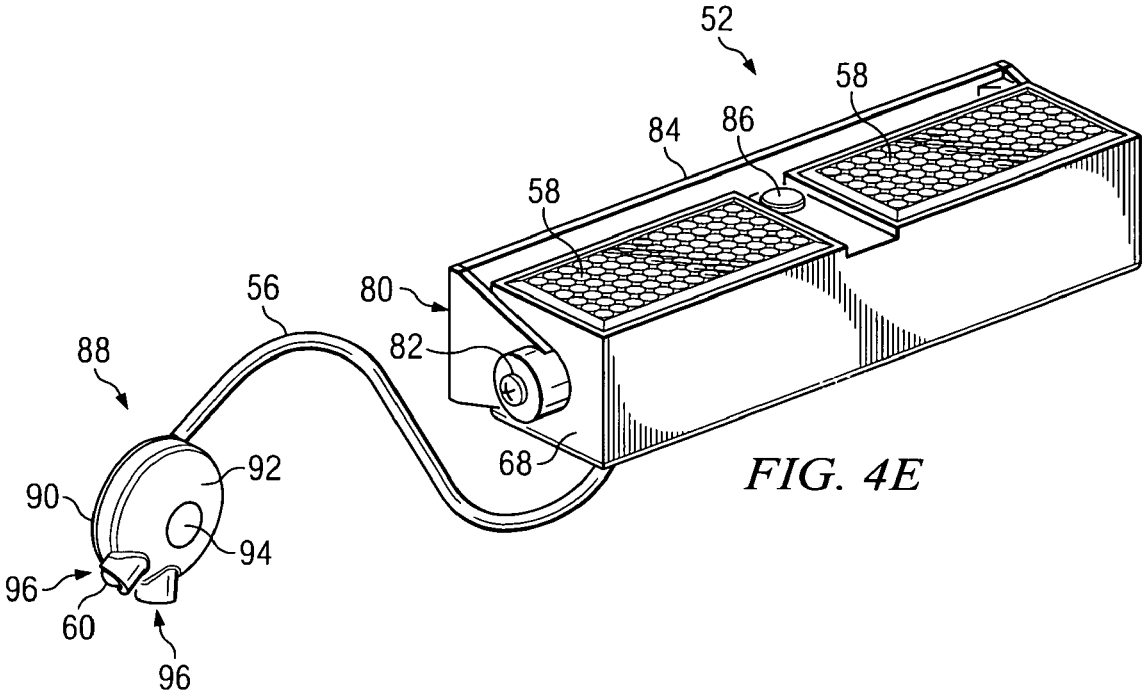
FIG. 4E is a perspective view of a portion of the bench system according to an alternate embodiment of the present invention.
Figure 5A:
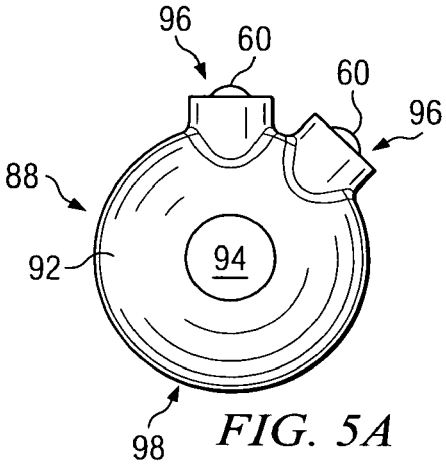
FIG. 5A is a top view of a portion of the bench system according to an alternate embodiment of the present invention.
Figure 5C:
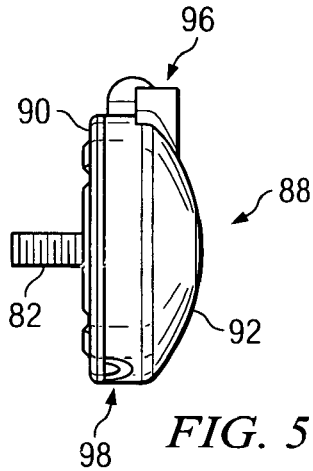
FIG. 5C is a side view of the bench system of FIG. 5A.
Figure 5B:
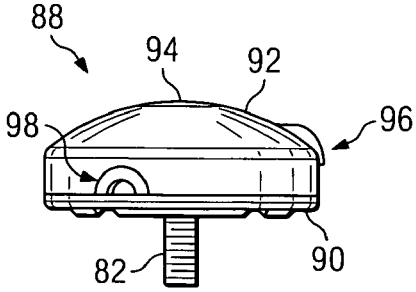
FIG. 5B is a side view of the bench system of FIG. 5A.

Referring now to FIGS. 3A and 3B in the drawings, an alternative embodiment of bench system 10 is illustrated. The form and construction of this alternate embodiment of bench 10 is substantially similar to that of the preferred embodiment. However, as compared to the preferred embodiment, the placement of decorations 20 and the placement and configuration of lighting system 18 are different. In this alternate embodiment, decorations 20 are located between arm rests 28 and horizontal portions 24 of each end 12. Also, multiple lighting elements 60 are remote from enclosure 52 and are located along arm rests 28 in a manner such that the lighting elements 60 illuminate decorations 20 with strips of illumination. Further alternate embodiments of bench system 10 may include more than one lighting system 18 to independently power multiple lighting elements 60.

Referring now to FIGS. 4A-5E in the drawings, an alternative embodiment of bench system 10 is illustrated. In this alternate embodiment, lighting system 18 differs substantially from the preferred embodiment in that enclosure 52 is substantially box shaped and is substantially rectangular as viewed from either side, from above, and from below, and lighting elements 60 are remote from enclosure 52 (see FIG. 4E). In this alternate embodiment, solar collectors 58 are located on top of enclosure 52 rather than extending from enclosure 52 as described in the preferred embodiment.

A swivel bracket 80 is adjustably attached to enclosure left side 66 and enclosure right side 68 with a plurality of fasteners 82. Fasteners 82 are preferably screws but may alternately be rivets, brads, bolts, or any other suitable fastener for adjustably or fixedly attaching swivel bracket 80 to enclosure 52. It should be understood that while in this embodiment swivel bracket 80 is adjustable, alternate embodiments of brackets may be fixedly attached to enclosure 52. Swivel bracket 80 comprises a mounting portion 84 through which there are holes (not shown) and slots (not shown). In this embodiment, mounting portion 84 is attached to back rest back 48 (see FIG. 1A) with fasteners 82.

While swivel bracket 80 is substantially "U" shaped, it may alternately be formed in any manner appropriate for adjustably attaching enclosure 52 to bench system 10. Also, while swivel bracket 80 is fixedly attached to back rest back 48 in this embodiment, it may alternately be fixedly or adjustably attached to seat 14, back rest 16, or ends 12. Alternate embodiments may not include swivel bracket 80 and enclosure 52 may be fixedly or adjustably fastened to seat 14, back rest 16, or ends 12 with screws, rivets, brads, bolts, or any other suitable fastener. Enclosure 52 may be fixedly or adjustably adhered to seat 14, back rest 16, or ends 12 with glue, epoxy, Velcro, or other appropriate means for adhering.

In this alternate embodiment, a photo resistor, or photo cell, 86 is incorporated into lighting system 18 (see FIGS. 4A-4E). Photo cell 86 is preferably mounted on enclosure 52. Photo cell 86 detects the presence of light and controls whether lighting elements 60 provide illumination or not by switching lighting elements 60 on or off, or by regulating the amount of light lighting elements 60 provide. For example, when photo cell 86 detects a substantial amount of light, lighting elements 60 are switched off and provide no illumination. However, when photo cell 86 detects a low level of light, lighting elements 60 are switched on and provide illumination. Alternately, photo cell 86 may be used to dim or brighten the output of lighting elements 60.

Also in this alternate embodiment, lighting elements 60 are carried by a light housing 88 (see FIGS. 4E-5E). Light housing 88 preferably comprises a light housing base 90, a light housing top 92, and a light housing cap 94. Lighting elements 60 are substantially located in a plurality of light slots 96 in the light housing cap 94. Electrical connectors 56 pass through a connector slot 98 in the light housing cap 94. In operation, a fastener 82 is used to secure light housing 88 to back rest front 46 by inserting the fastener through a hole in the light housing 88. However, light housing 88 may alternately be adhered to back rest front 46 with glue, epoxy, Velcro, or other appropriate means for adhering. Also, light housing 88 may alternately be attached to seat 14, back rest 16, or ends 12 at locations other than back rest front 46. Finally, light housing cap 94 is inserted into the hole in light housing 88 to seal the hole.

In this embodiment, light housing 88, swivel bracket 80, and enclosure 52 are preferably constructed of rigid plastic but may alternately be constructed of a combination of plastic, metal, wood, or any other suitable material.

In other alternate embodiments, lighting elements 60 may be carried by enclosure 52 whereby the entire lighting system is located within, on, or about enclosure 52. Lighting element 60 can alternately be located on any side or face of enclosure 52, as a matter of design choice. It should be appreciated that where lighting system 18 is fully within, on or about enclosure 52, enclosure 52 may be attached to seat 14, back rest 16, or ends 12 at any suitable location. Also, when enclosure 52 carries the entire lighting system 18, enclosure 52 may be inset, inlaid, or disposed in a recessed space of seat 14, back rest 16, or ends 12. For example, back rest 16 may have a space cut out for fully or partially receiving enclosure 52 whereby lighting elements 60 may illuminate bench system from a recessed area of back rest 16. Similarly, any embodiment of the present invention may incorporate the placement of any portion of lighting system 18 in an inset, inlaid, or recessed space of seat 14, back rest 16, or ends 12.

Figure 6:
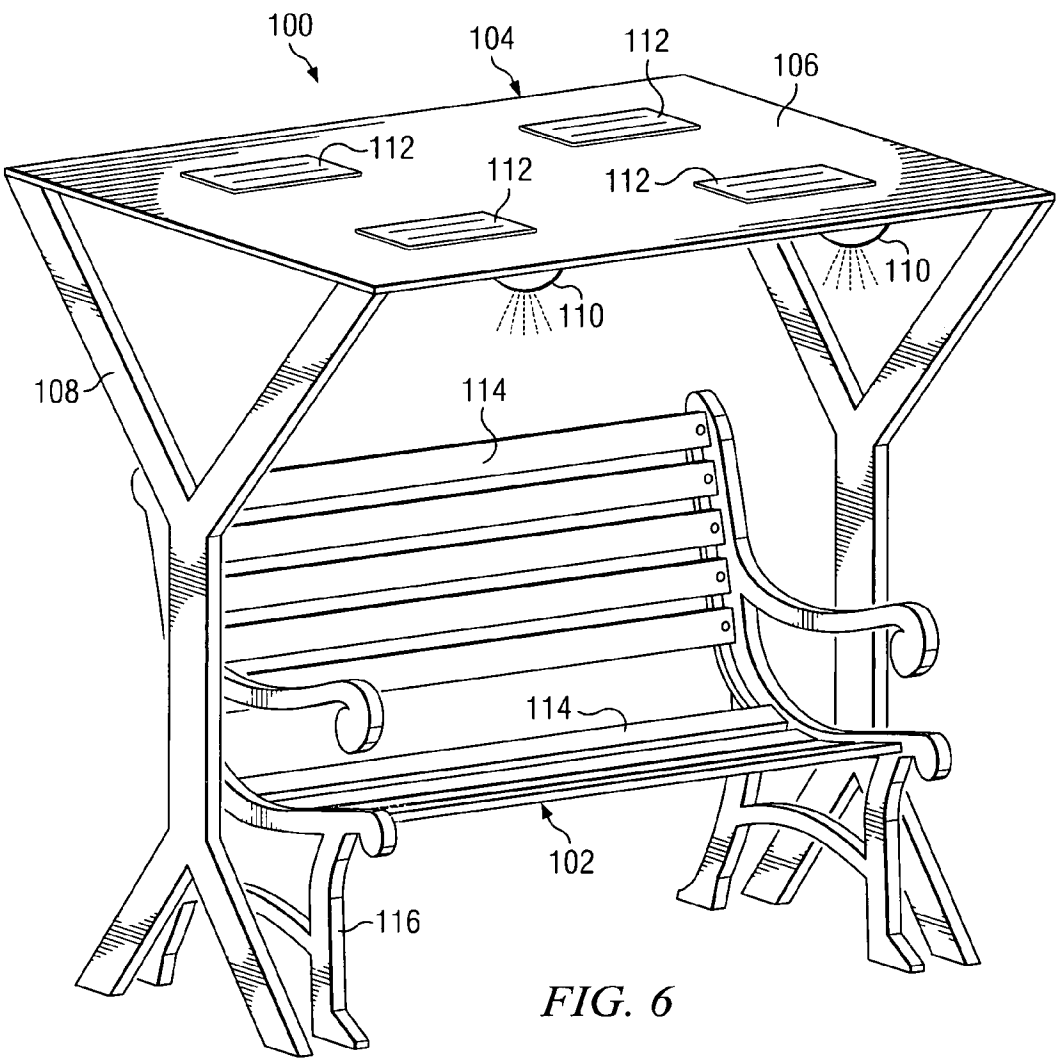
FIG. 6 is a perspective view of a covered bench according to the present invention.
Figure 5D:
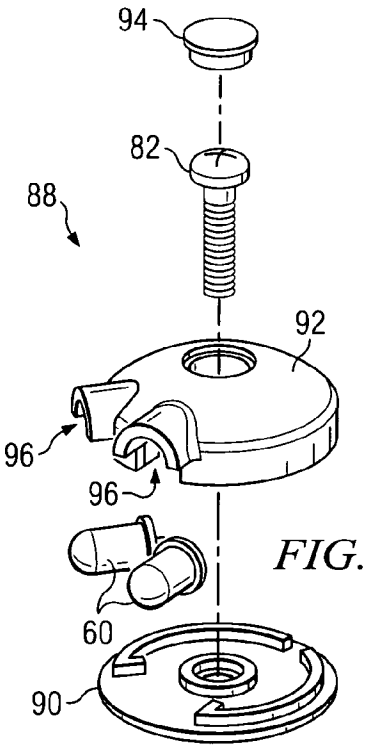
FIG. 5D is an exploded perspective view of the bench system of FIG. 5A.
Figure 5E:
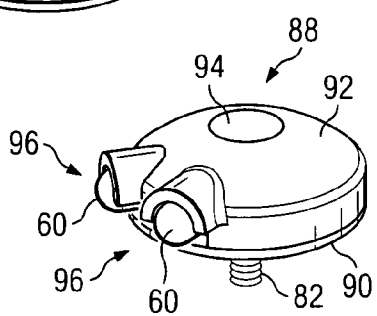
FIG. 5E is a perspective view of the bench system of FIG. 5A.

An additional alternate embodiment is shown in FIG. 6. Lighted bench 100 comprises a bench portion 102 and a canopy portion 104. Canopy portion 104 has a canopy 106 supported by frame 108, with canopy 106 being positioned over bench portion 102 to provide shade during daylight hours or cover from falling precipitation. To provide light under canopy 106, lighting elements 110 are preferably mounted on canopy 106, though light may be mounted in any appropriate location on canopy portion 104, such as on frame 108, or on bench portion 102. Lighting elements 110 are powered by a rechargeable electrical system (not shown), and the electrical system is recharged with electricity provided by solar collectors 112. Solar collectors 112 are shown as being mounted on canopy 106, though collectors 112 may be mounted in any appropriate location on canopy portion 104 or on bench portion 102. Bench portion 102 has a bench 114 that may be supported by legs 116, as shown, or may be supported by frame 108. Also, bench 114 may be movably attached to legs 116 or to canopy portion 104 for providing a bench having a rocking motion.

It should also be appreciated that seat 14, back rest 16, or ends 12 may be constructed of a translucent material or other material capable of light transmission. Where an element of the bench system 10 is capable of light transmission, lighting elements 60 may be used to illuminate the interior or exterior of those elements providing a decorative and/or functional display of light.

Figure 7:
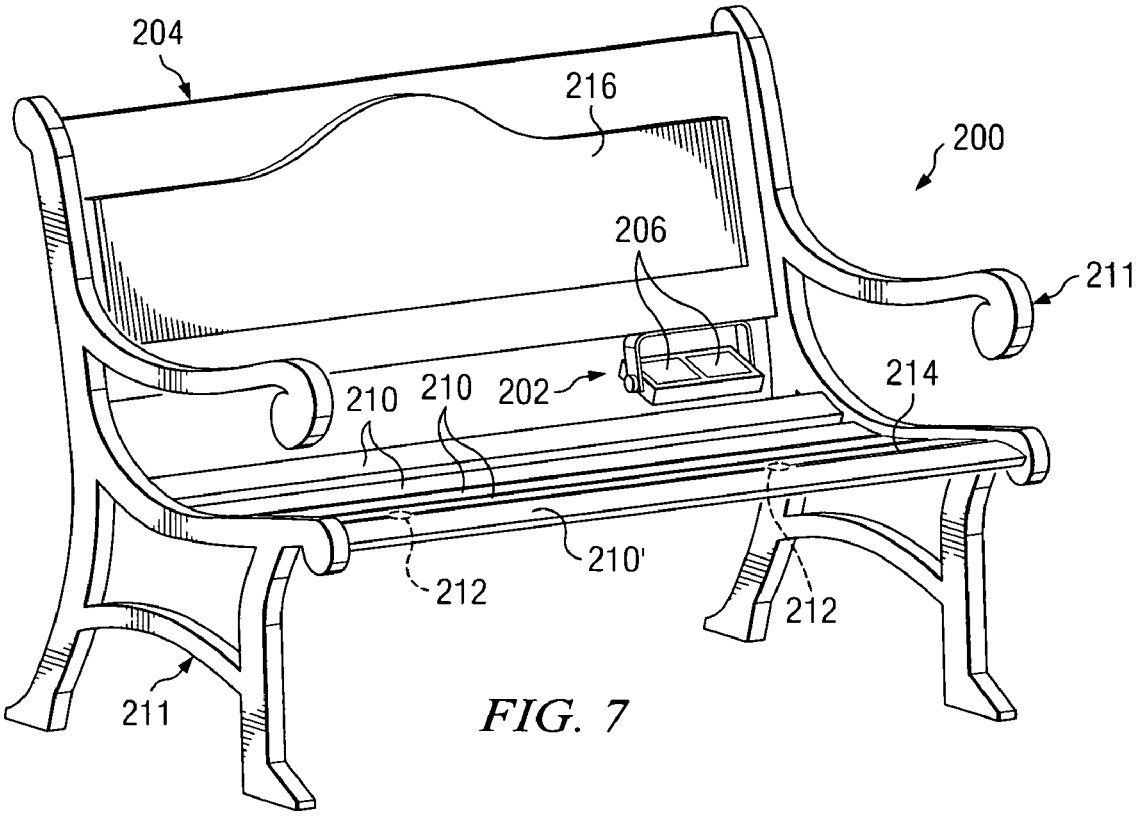
FIGS. 7-13 are perspective views of another alternate embodiment of a bench system according to the present invention.
Figure 8:
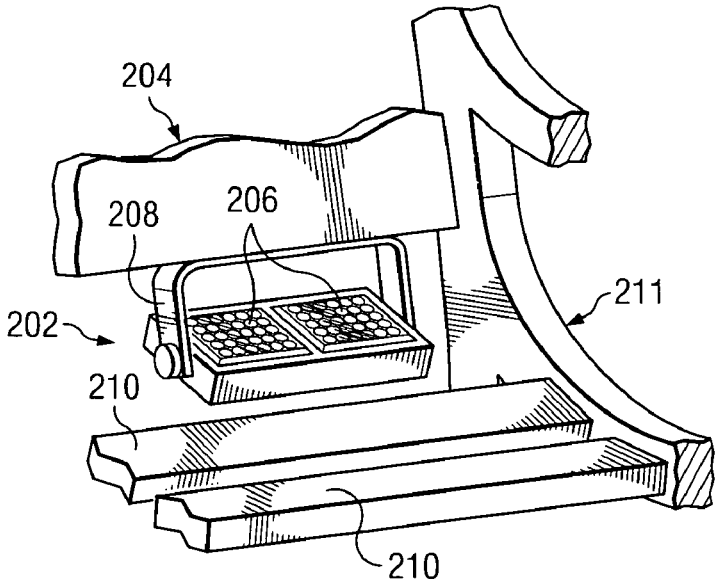
Figure 9:
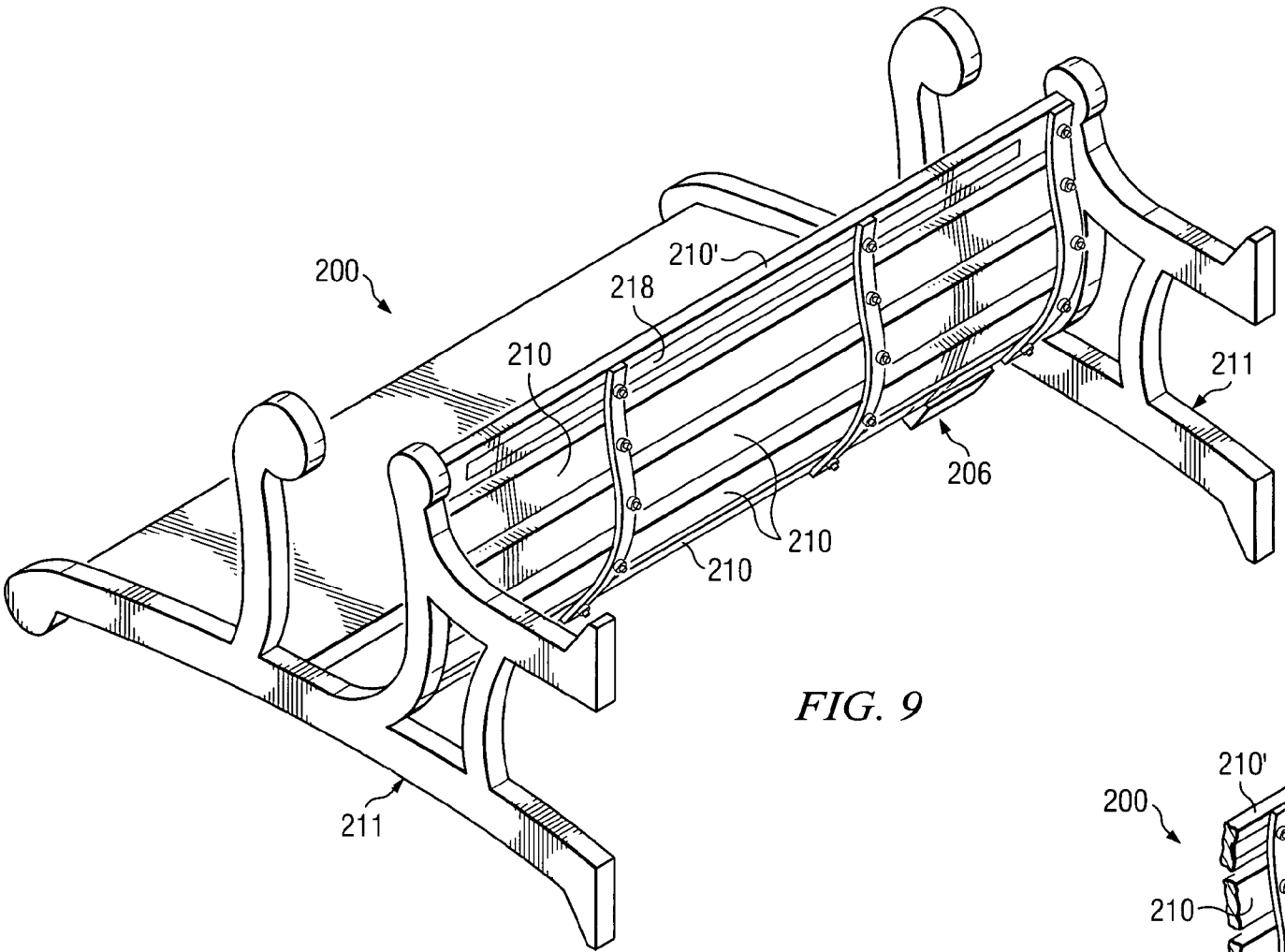
Figure 10:
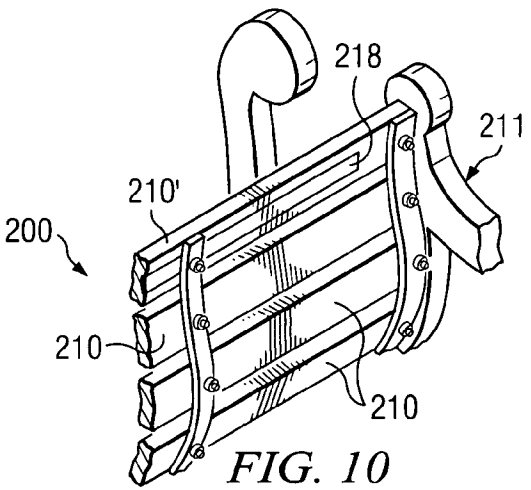
Figure 13:
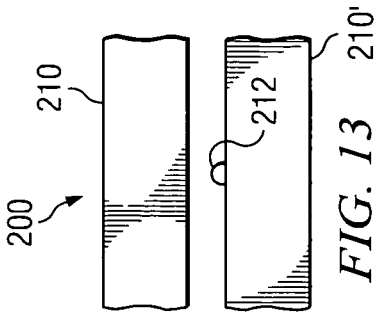
Figure 12:
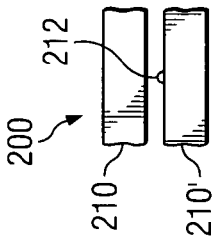
Figure 11:
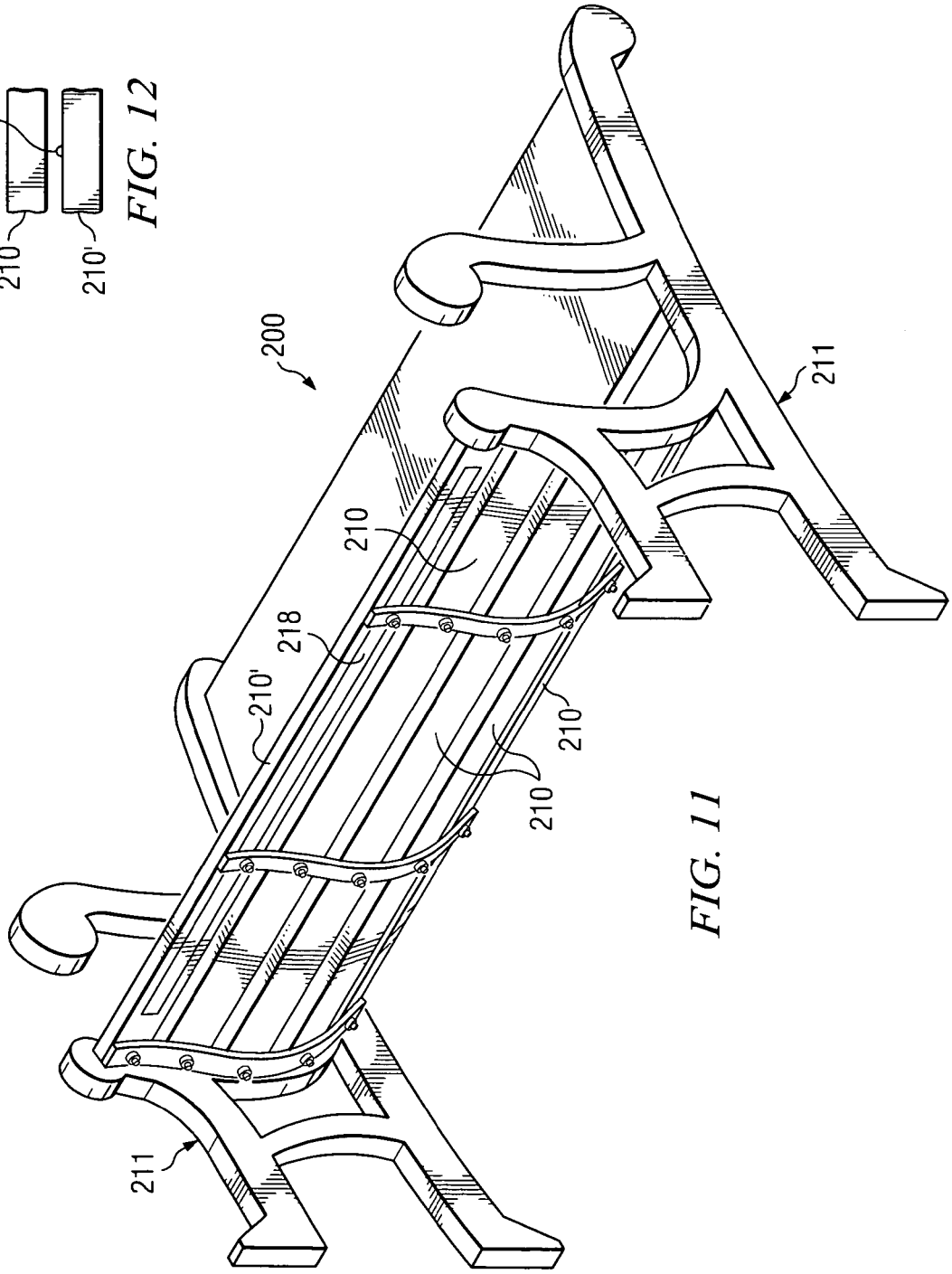
Figure 14:
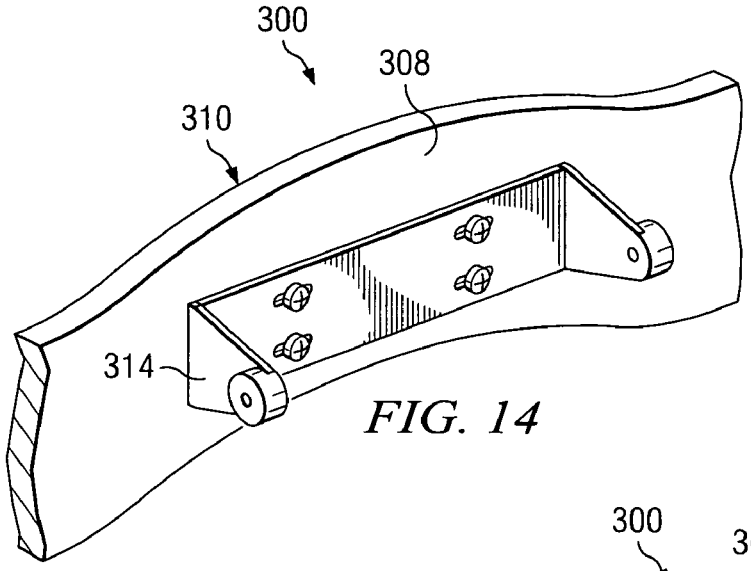
FIGS. 14-16 are perspective views of another alternate embodiment of a bench system according to the present invention.

Referring now to FIGS. 7-13 in the drawings, an alternate embodiment of a bench system 200 according to the present invention is illustrated. Bench system 200 is substantially similar to bench system 10, but with a few important differences. As illustrated in FIG. 7, a first difference is that bench system 200 is illustrated as having an enclosure 202 which is substantially similar to enclosure 52, mounted on a back rest member 204 such that solar collectors 206 are optimally exposed to light. Further, as best illustrated in FIG. 8, enclosure 202 is mounted to bench system 200 with a swivel bracket 208 similar to swivel bracket 80 such that enclosure 202 can be moved to positions for optimal solar collection and to prevent contact with users who may sit on bench system 200. Bench system 200 is also illustrated as having multiple slats 210 which form a seating surface. Back rest member 204 and slats 210 are connected at their ends to cast iron end frames 211. Further, lighting elements 212 are illustrated as being carried by a forwardly located slat 210'. More specifically, as illustrated in FIGS. 13 and 14, lighting elements 212 are preferably partially recessed into a rear face 214 of slat 210' such that light emitted from lighting elements 212 substantially illuminates decorative feature 216 which is carried by back rest member 204. Lighting elements 212 may alternatively be directed toward any other feature of bench system 200 or area around bench system 200. Slat 210' is preferably formed to receive lighting elements 212 by boring holes along the length of slat 210', boring holes into a face of slat 210', routing channels into a face of slat 210' (such as with a conventional carpenter's router tool), or any combination of these or other means of creating channels, bores, voids, or recesses for receiving lighting elements 212. Further, slat 210' may be formed to have a face which orients the lighting elements carried by that face in a manner to illuminate a particular feature of or area about bench system 200. Lighting elements 212 may be conductively coupled through conventional electrical wiring, through electrical conductors integral to slat 210', or any other means of conductively coupling lighting elements 212 to a power source. Further, slat 210' may be formed such that slat 210' may be easily removed from bench system 200 in a modular fashion. For example, if a lighting element fails, the user may simply replace the entire slat 210' instead of having to perform other forms of repair. Lighting elements 212 may alternatively be mounted to slat 210' in a manner allowing modular replacement of lighting elements 212 such that each lighting element may be replaced individually with ease. Of course any conventional electrical conductor connections and/or modular (snap-in, quick-release, interference fit, or other connection) connections are preferably weather resistant and/or weather proof such that rain or undesirable matter will not interfere with the performance of the lighting system. Also, slat 210' may alternatively be located such that it is not the most forwardly located slat 210. Of course any wires, channels, and/or other elements of the lighting system are preferably substantially hidden from view by a weatherproof cover 218 or other means of retaining wiring and electrical elements to or within slat 210'.

Figure 15:
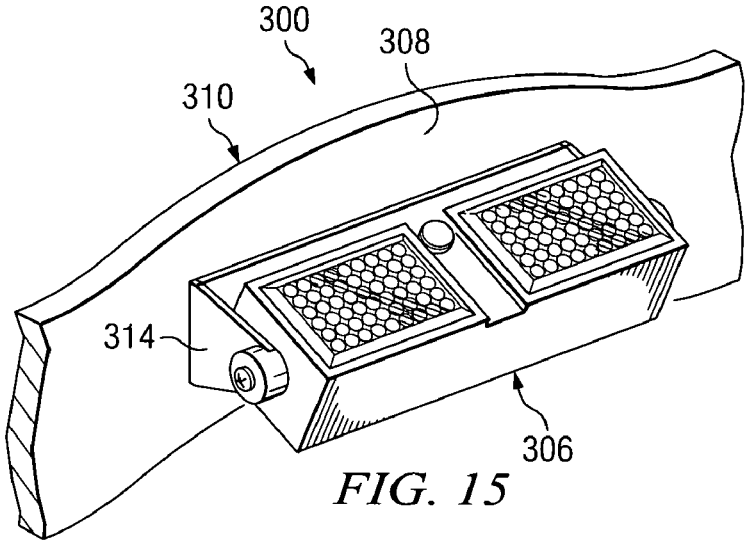
Figure 16:
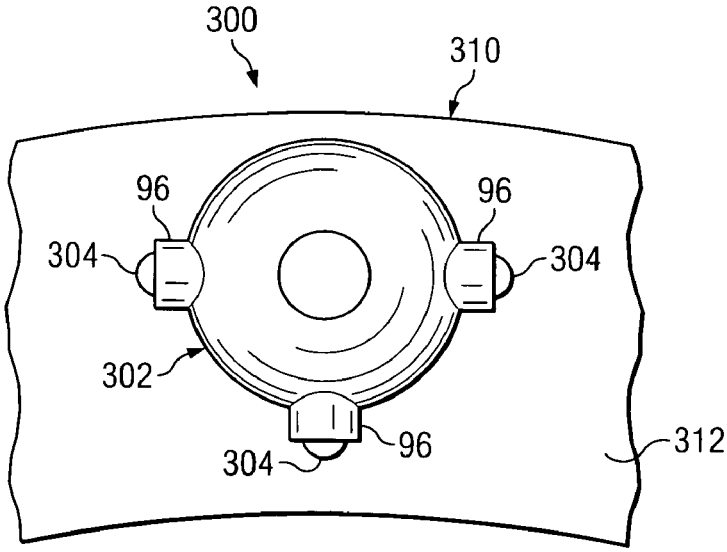

Referring now to FIGS. 14-16 in the drawings, an alternate embodiment of a bench system 300 according to the present invention is illustrated. Bench system 300 includes a bench substantially similar to the bench of bench system 200 in combination with the lighting system elements substantially similar to the elements illustrated in FIGS. 4E-5E. The main difference between the lighting housing 302 and lighting housing 88 is that lighting housing 302 is illustrated as having three light slots 96 to accommodate three lighting elements 304. Further, enclosure 306 is illustrated as being attached to a back side 308 of the back rest 310. Lighting housing 302 is illustrated as being attached to a front side 312 of back rest 310. Enclosure 306 is substantially similar to enclosure 52 and enclosure 306 carries substantially the same lighting system elements as enclosure 52. Enclosure 306 is attached to the back rest 310 with a swivel bracket 314.

Figure 17:
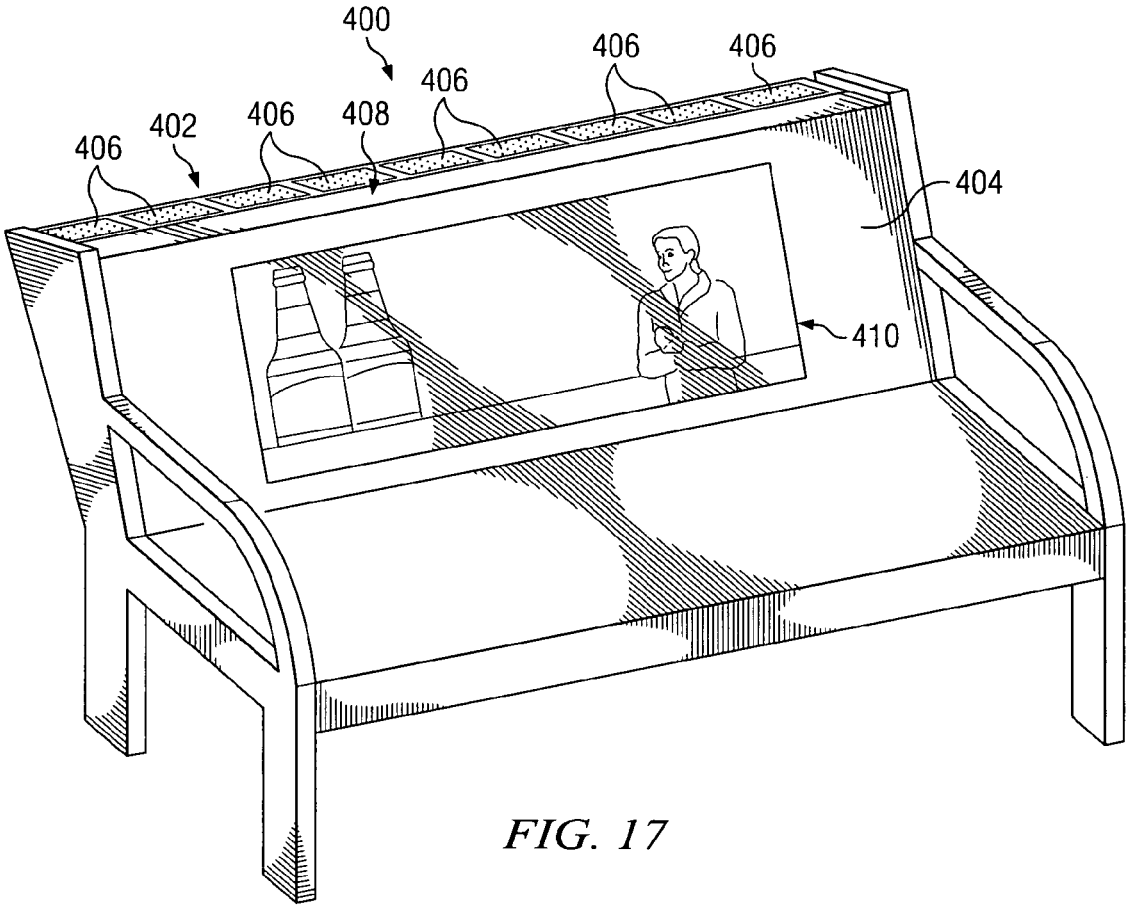
FIGS. 17 and 18 are perspective views of another alternate embodiment of a bench system according to the present invention.
Figure 18:
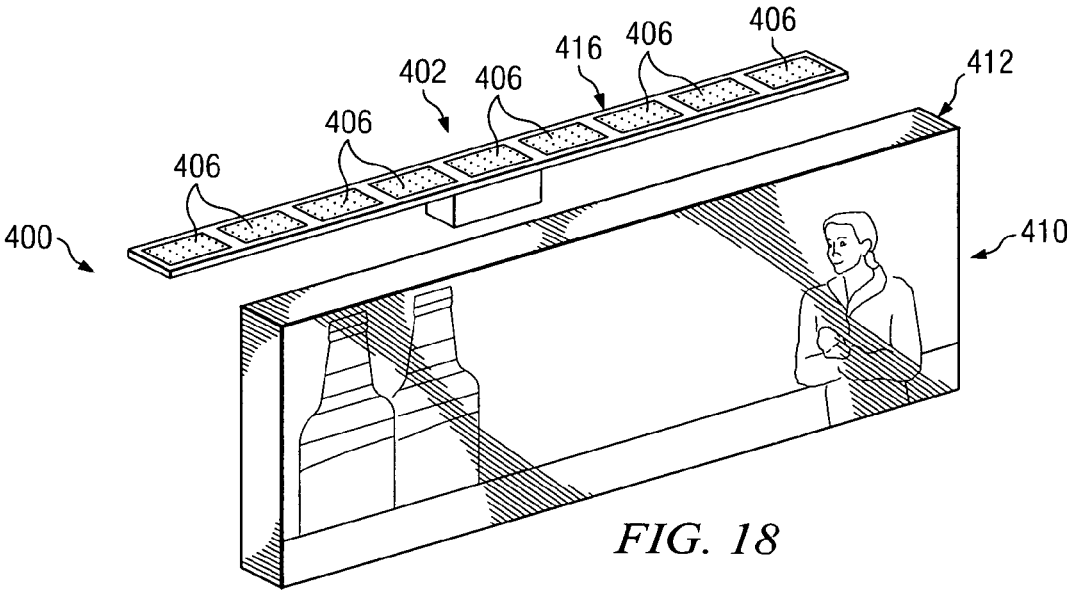

Referring now to FIG. 17 in the drawings, an alternate embodiment of a bench system 400 according to the present invention is illustrated. Bench system 400 is illustrated has having an integrated lighting system 402 substantially similar to lighting system 18 in electrical function. However, the elements of lighting system 402 are located differently than the elements of lighting system 18. For example, lighting system 402 is illustrated as being substantially located within a substantially enclosed space behind back rest 404 such that lighting system 402 is carried by or otherwise substantially located near and/or supported by back rest 404. Solar collectors 406 are illustrated as being located substantially along a top side 408 of back rest 404. Lighting elements (not shown) are preferably located within the enclosed space behind back rest 404 such that illumination emitted from lighting elements backlights a translucent graphical indicia 410 which is carried by back rest 404. Back rest 404 is illustrated as having a hole or other portion cut out of the back rest such that light may pass through the indicia 410 which is mounted preferably flush to back rest 404. Of course indicia 410 may carry commercial advertisements or any other suitable graphical representations. FIG. 18 illustrates different portions of the lighting system 402 as having a boxlike enclosure 412 for optionally mounting indicia 410 thereto and subsequently mounting enclosure 412 to back rest 404. Solar collectors 406 are illustrated as being mounted to a support bar 416 for easy integration and mounting to back rest 404. Of course any portion of lighting system 402 may be located at different places on or about bench system 400 while still providing the overall effect of backlighting indicia 410. Of course, lighting system 402 may alternatively be adapted for integral mounting into any other suitable portion of the bench such as an arm rest portion.

Figure 19:
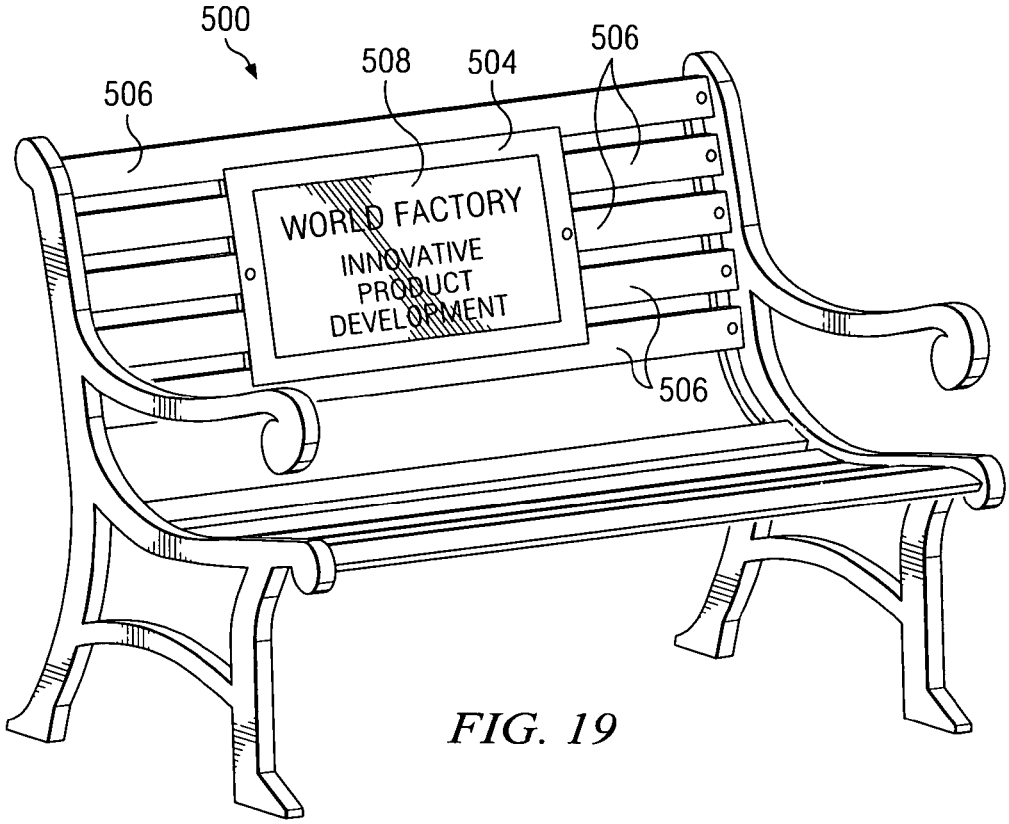
FIG. 19 is a perspective view of another alternate embodiment of a bench system according to the present invention.

Referring now to FIG. 19 in the drawings, an alternate embodiment of a bench system 500 according to the present invention is illustrated. Lighting system 502 is illustrated as being substantially contained within an enclosure 504 adapted for easy integration onto an existing bench. FIG. 18 illustrates that enclosure 504 can be mounted to the back rest slats 506. As in bench system 400, bench system 500 is illustrated as having a translucent indicia 508 for being illuminated from behind.

Figure 21:
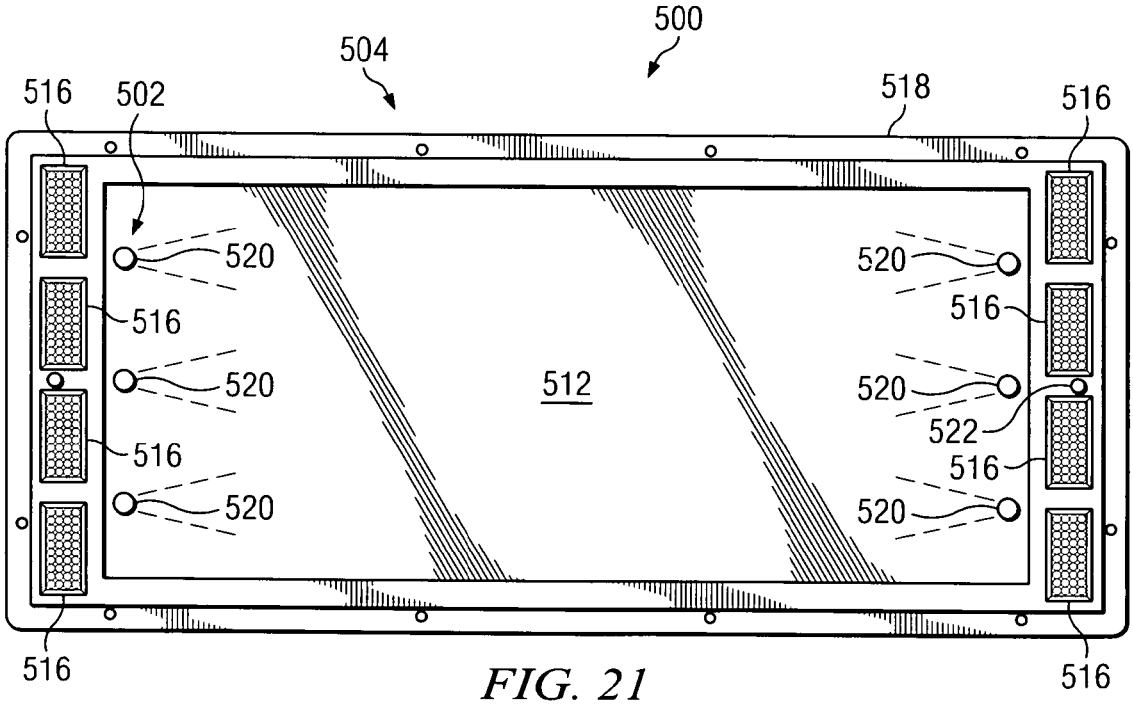
FIG. 21 is a front view of the enclosure of the bench system of FIG. 19.
Figure 20:
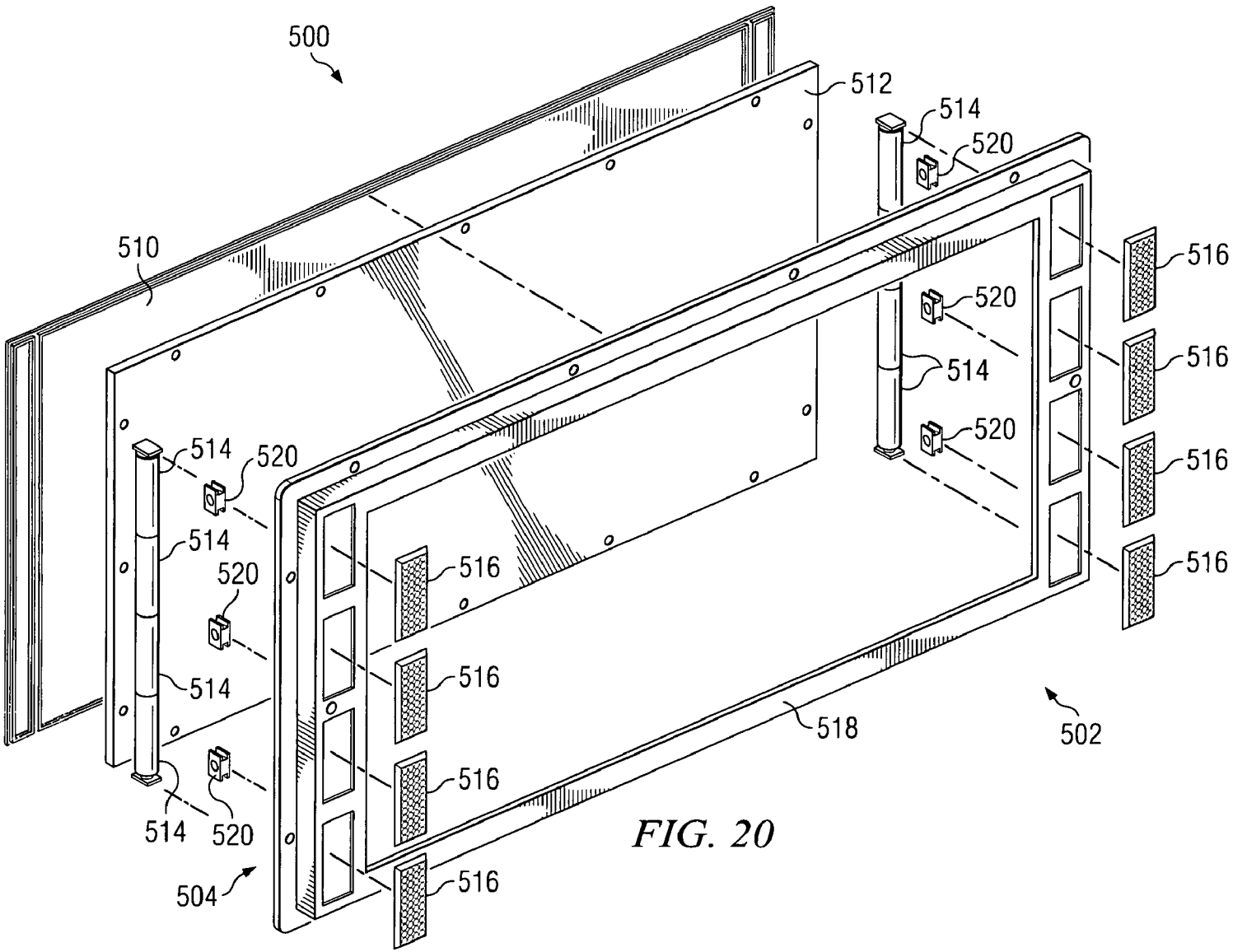
FIG. 20 is an exploded perspective view of the enclosure of the bench system of FIG. 19.
Figure 22:
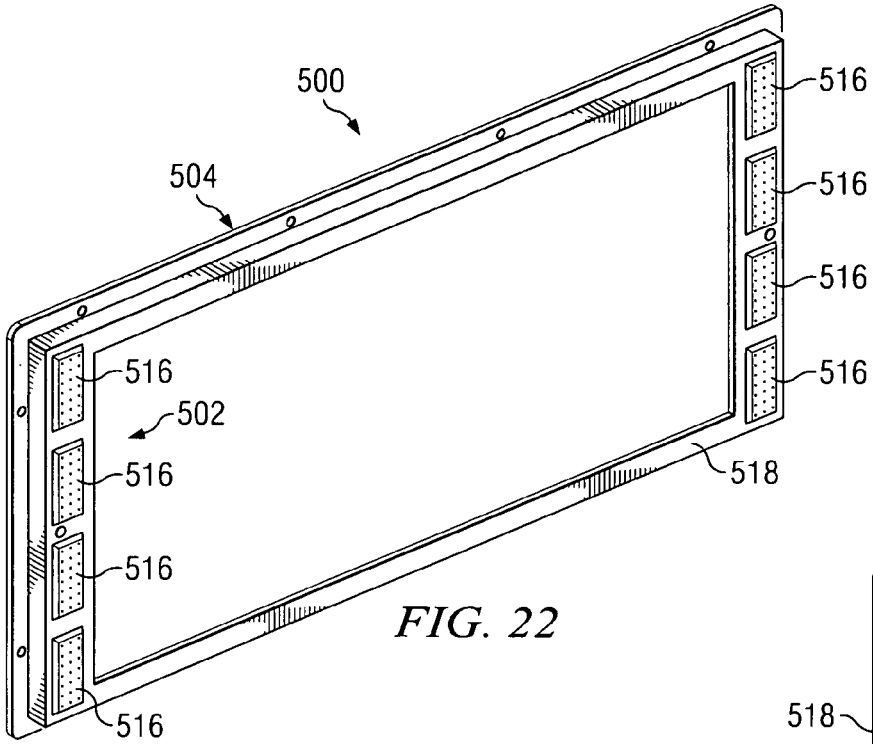
FIG. 22 is a perspective view of the front housing of the bench system of FIG. 19.
Figure 23:
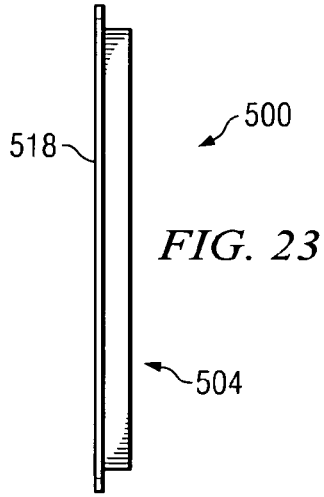
FIGS. 23 and 24 are side and front the use of the front housing of the bench system of FIG. 19, respectively.
Figure 24:
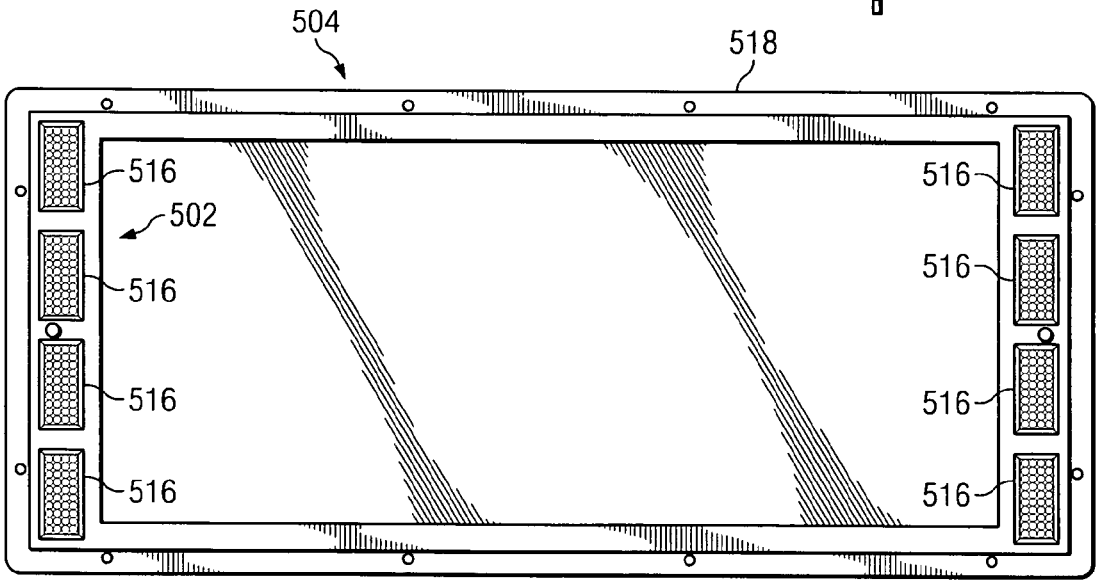

FIGS. 20-22 illustrate enclosure 504 as comprising a backplate 510, a translucent lens 512, batteries 514, solar panels 516, a front housing 518, and lighting elements 520. Of course different indicia 508 may be swapped into and out of enclosure 504 so as to allow frequent changing of advertisements. A photo cell 522 may optionally be incorporated into the lighting system.

Of course enclosure 504 may alternatively be adapted for mounting to other portions of a conventional bench or other seating apparatus.

Figure 25:
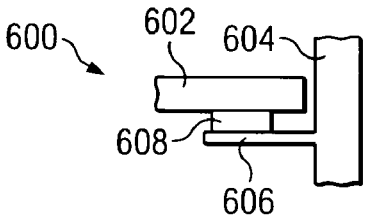
FIG. 25 is a front view of another alternate embodiment of a bench system having a pressure switch for activating a lighting system according to the present invention.

Referring now to FIG. 25 in the drawings, an alternate embodiment of a bench system 600 according to the present invention is illustrated. Bench system 600 is substantially similar to bench system 200. Bench system 600 comprises slats 602 and end frames 604. Each slat 602 is supported at both ends of the slat 602 by an end frame 604. An end frame 604 comprises a support shelf 606 for vertically supporting a slat 602. Bench system 600 further comprises a pressure sensitive device 608 disposed between slat 602 and support shelf 606 such that when pressure is applied downward on to slat 602, such as when a user sits atop slat 602, a lighting system (not shown) is activated and provides illumination. Pressure sensitive device 608 is also adapted to deactivate the lighting system when the above described pressure is removed. The lighting system may further be adapted to remain activated for a particular period of time following the initial activation caused by pressure being sensed by pressure sensitive device 608. Of course, pressure sensitive device 608 may optionally be incorporated into any other embodiment of the present invention.

Figure 26:
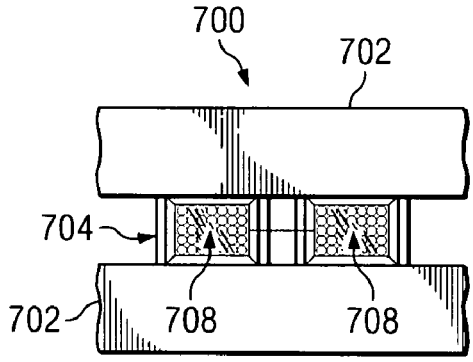
FIG. 26 is a partial top view of another alternate embodiment of a bench system having a solar collector located between slats according to the present invention.
Figure 27:
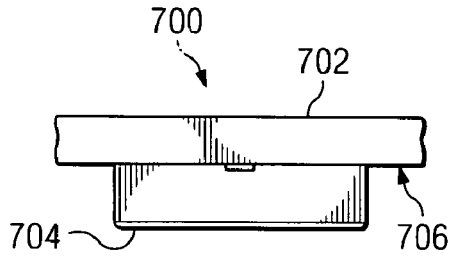
FIG. 27 is a partial side view of the bench system of FIG. 26.

Referring now to FIGS. 26 and 27 in the drawings, an alternate embodiment of a bench system 700 according to the present invention is illustrated. FIG. 26 is a top view of a portion of bench system 700 while the FIG. 27 is a side view of substantially the same portion of bench system 700. Bench system 700 is substantially similar to bench system 200. Slats 702 are substantially similar to slats 210. Two substantially parallel slats 702 are spaced slightly apart and adapted to accept solar collectors 704 on a bottom side 706 of slats 702. Solar collectors 704 are also positioned such that the light receiving portions 708 of solar collectors 704 are substantially disposed between adjacent slats 702. The described placement of solar collectors 704 allows solar collectors 704 to be mounted and substantially hidden from view and undesirable physical contact while still allowing sunlight or light from other sources to pass between slats 702 to reach light receiving portions 708.

Figure 28:
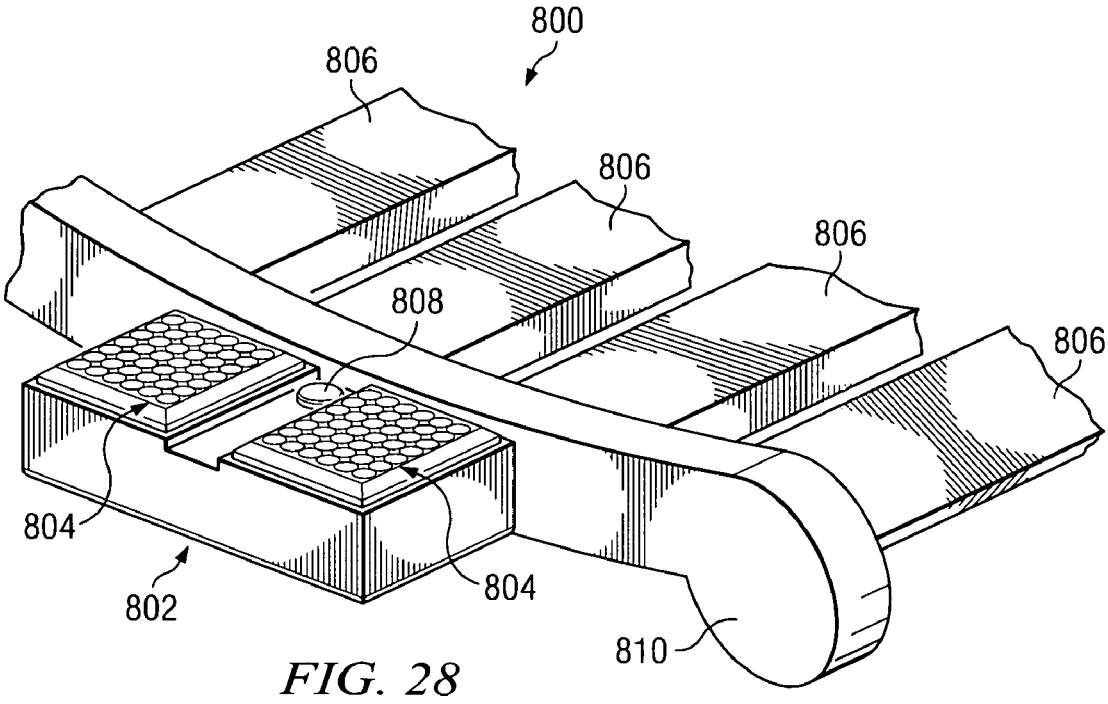
FIG. 28 is a partial perspective view of another alternate embodiment of a bench system having a solar collector mounted to an end frame according to the present invention.

Referring now to FIG. 28 in the drawings, an alternate embodiment of a bench system 800 according to the present invention is illustrated. Bench system 800 is substantially similar to bench system 200. Solar collector 802 is located substantially at an outer side of the bench structure. Particularly, solar collector 802 is located such that light receiving portions 804 and photocell 808 are generally coplanar with the top sides of slats 806 and such that portions 804 of collector 802 extend away from an area generally occupied by slats 806 and end frame 810. End frame 810 is substantially similar to frame 211. The described placement of solar collectors 802 allows solar collectors 802 to be mounted in a low visibility area not likely to interfere with a user of bench system 800 while still exposing portions 804 to light.

Figure 29:
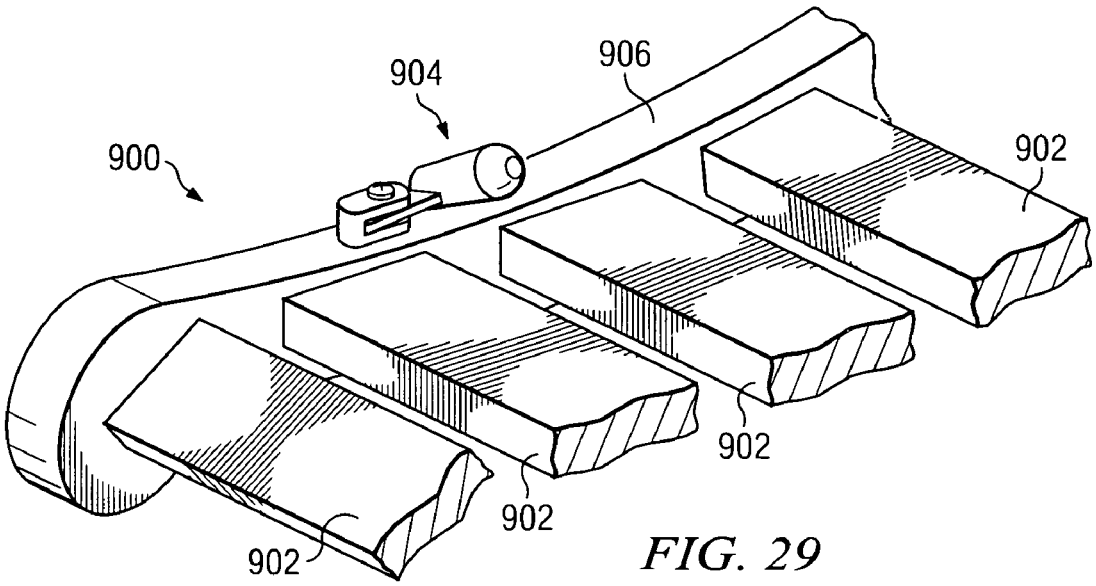
FIG. 29 is a partial perspective view of another alternate embodiment of a bench system having an aimable light mounted to an end frame according to the present invention.
Figure 30:
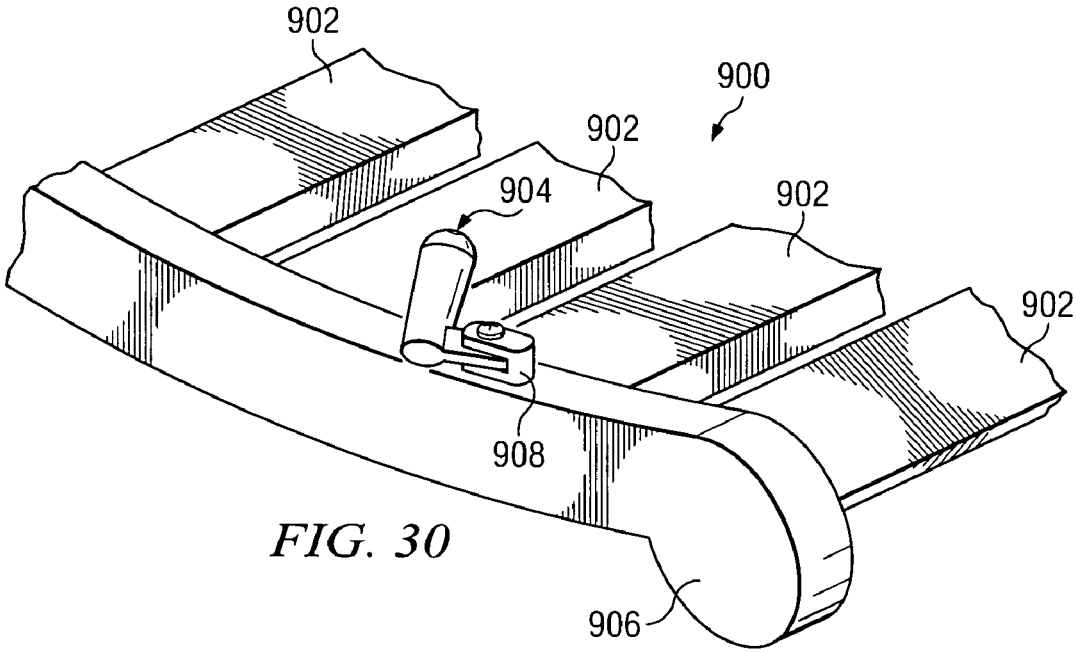
FIG. 30 is another partial perspective view of the bench system of FIG. 29.

Referring now to FIGS. 29 and 30 in the drawings, an alternate embodiment of a bench system 900 according to the present invention is illustrated. Bench system 900 is substantially similar to bench system 200. Slats 902 are substantially similar to slats 210. An aimable light 904 is located substantially at an outer side of the bench structure, similar to the location of collector 802 of system 800. End frame 906 is substantially similar to frames 211, 810. Light 904 is adapted to be mounted to frame 906 and/or slats 902 such that an articulated portion 908 of light 904 is operable to allow adjustment of light 904 to direct light toward various targets. Typical targets include the backrest of the bench structure, a space occupied by a user of the bench structure while sitting atop slats 902, and the top sides of slats 902. The described placement of light 904 allows light 904 to be mounted in a low visibility area not likely to interfere with a user of bench system 900 while still allowing illumination from light 904 to reach various targets.

Figure 31:
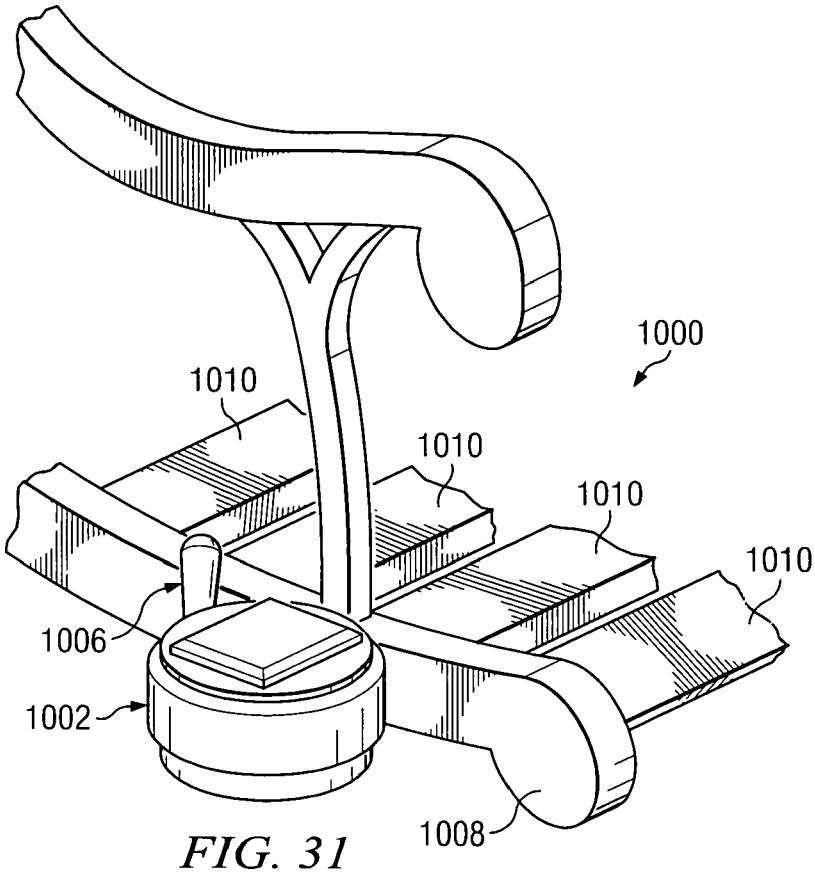
FIG. 31 is a partial perspective view of another alternate embodiment of a lighting system for a bench according to the present invention.
Figure 32:
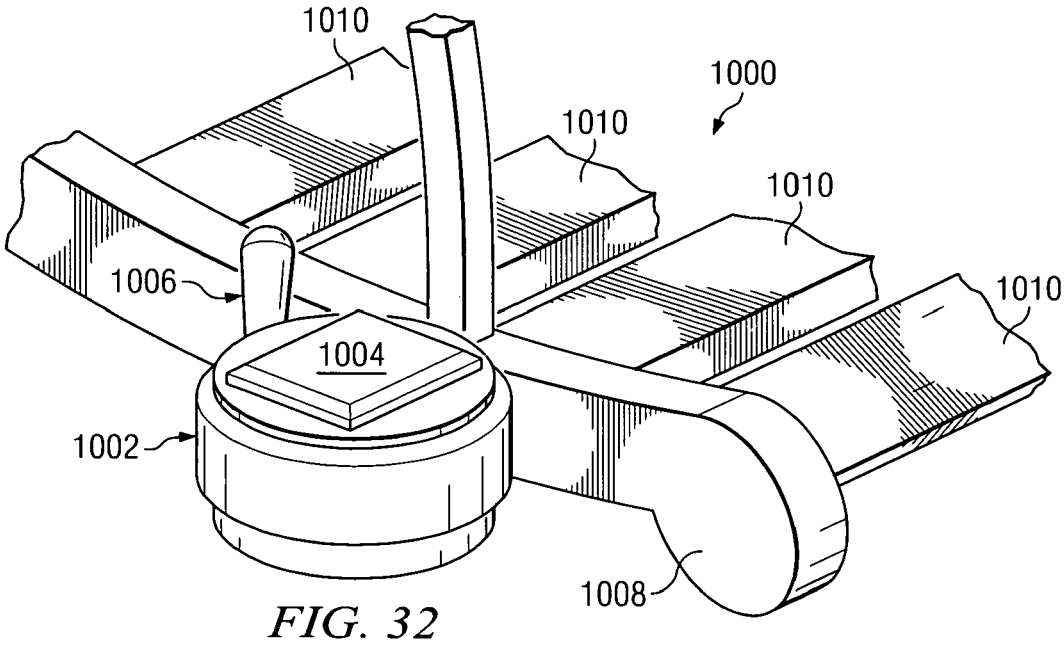
FIG. 32 is another partial perspective view of the lighting system for a bench of FIG. 31.

Referring now to FIGS. 31 and 32 in the drawings, an alternate embodiment of a bench lighting system 1000 according to the present invention is illustrated. Bench lighting system 1000 is substantially similar to lighting system 18 in function. System 1000 comprises a substantially disk shaped housing 1002 with a solar collector 1004 mounted atop housing 1002. An aimable light 1006 substantially similar to light 904 is also mounted to housing 1002 and is located such that light 1006 can illuminate selected targets similar to the targets that may be illuminated by light 904. Housing 1002 is mounted to end frame 1008 in a manner substantially similar to the manner collector 802 is mounted to frame 810. Slats 1010 are substantially similar to slats 210 and housing 1002 may optionally be mounted to slats 210 or any other suitable portion of the bench structure. End frame 1008 is substantially similar to frames 211, 810, 906. Light 1006 comprises an articulated portion (not shown) substantially similar to portion 908. The described placement and design of system 1000 allows system 1000 to be mounted to a variety of conventional bench structures in a manner not likely to interfere with a user of the conventional bench while still allowing illumination from light 1006 to reach various targets and allowing light to reach collector 1004. An optional remotely located aimable light (not shown) may be incorporated into system 1000 and provides a second source of illumination. Where the optional remotely located aimable light is incorporated, the remote light is preferably mounted on the frame 1008 at the end of the bench structure opposite the frame 1008 which carries housing 1002. The remote light is substantially similar in form, function, and means of mounting to light 904. Of course the remote light could be located at any other suitable place on or about the bench structure.

Figure 33:
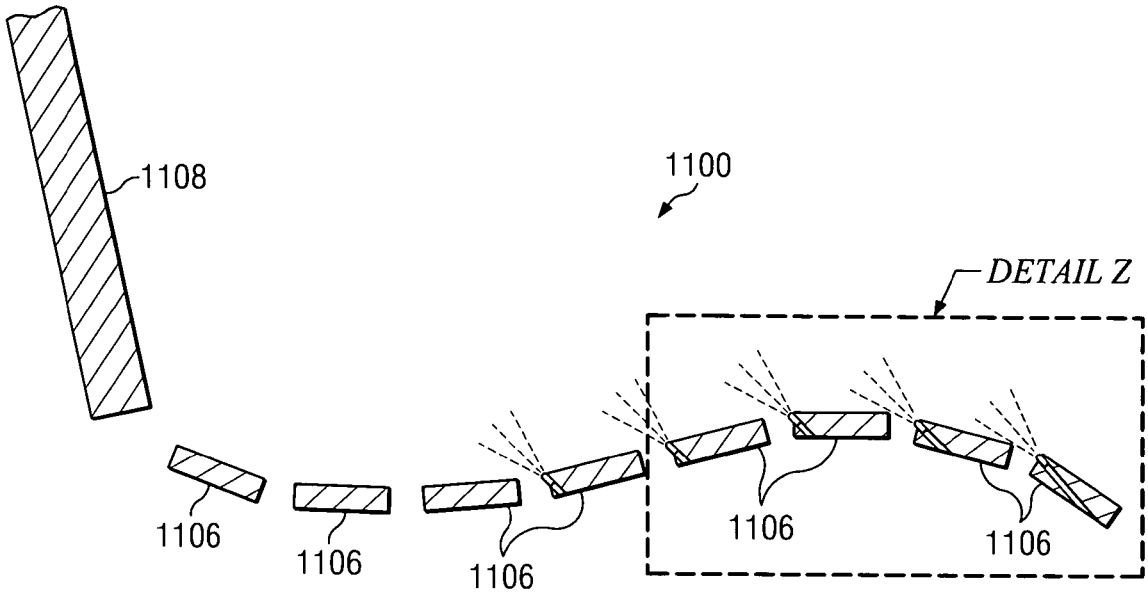
FIG. 33 is a simplified diagrammatic partial cross-sectional view of another alternate embodiment of a bench system having directional bores according to the present invention.
Figure 34:
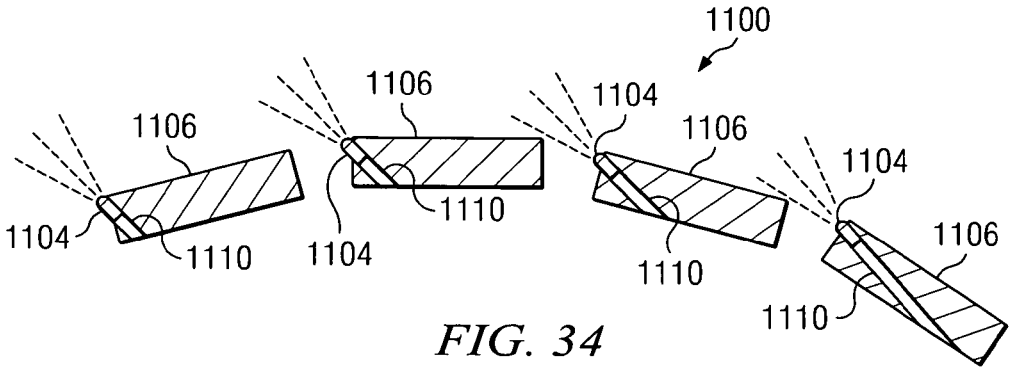
FIG. 34 is another simplified diagrammatic partial cross-sectional view of the bench system of FIG. 33.

Referring now to FIGS. 33 and 34 in the drawings, an alternate embodiment of a bench system 1100 according to the present invention is illustrated. FIG. 33 is a simplified cross section of system 1100. FIG. 34 is a view of Detail Z of FIG. 33. Bench system 1100 is substantially similar to lighting system 200 in form and function. System 1100 comprises LED lights 1104 substantially similar to lighting elements 212, slats 1106 substantially similar to slats 210, and a backrest 1108. Slats 1106 have directional bores 1110 drilled therethrough to house lights 1104 much like elements 212 are housed within slat 210'. Bores 1110 are drilled particularly to orient lights 1104 toward backrest 1108, irrespective of the angular orientation of slats 1106. Of course in a different embodiment, bores 1110 may be drilled to orient lights 1104 toward a target other than backrest 1108. Electrical conductors (not shown) connected to lights 1104 are easily passed through bores 1110 and routed discretely along the length of slats 1106 as necessary.

It should be appreciated that the above embodiments of lighting systems may alternatively be incorporated onto a seating apparatus other than a conventional bench. For example, gliders, chairs, swings, and other seating devices are suitable for use with many of the lighting systems described above. More specifically, a lighting system could be adapted to illuminate graphical indicia carried by an awning over a seating apparatus or an awning integral to a seating apparatus.

While this invention has been described with reference to an illustrative embodiment, this description is not intended to be construed in a limiting sense. Various modifications and other embodiments of the invention will be apparent to persons skilled in the art upon reference to the description.

We claim:

1. A bench system, comprising:

a plurality of ends;

at least one seat supported by the ends;

a lighting system, coupled to the bench system for providing illumination, wherein the lighting system provides illumination to exterior surfaces of the bench system from a location exterior to the bench system; and a solar recharging system for collecting solar energy and converting the solar energy into electrical energy for providing power to the lighting system.

2. The bench system according to claim 1, wherein at least a portion of the lighting system is carried within a recessed space within one end.

3. The bench system according to claim 1, wherein at least a portion of the lighting system is carried within a recessed space within the seat.

4. The bench system according to claim 1, wherein at least a portion of the lighting system is attached to the end.

5. The bench system according to claim 1, wherein at least a portion of the lighting system is attached to the seat.

6. The bench system according to claim 1, wherein at least a portion of the lighting system is attached to an arm portion of at least one of the ends.

7. The bench system according to claim 1, further comprising:

at least one back rest.

8. The bench system according to claim 7, wherein at least a portion of the lighting system is carried within a recessed space within the back rest.

9. The bench system according to claim 7, wherein at least a portion of the lighting system is attached to the back rest.

10. The bench system according to claim 1, wherein the lighting system further comprises:

at least one remote lighting element.

11. The bench system according to claim 1, wherein the lighting system further comprises:

a strip of lights.

12. The bench system according to claim 1, wherein the lighting system further comprises:

a rechargeable power system.

13. The bench system according to claim 12, wherein the rechargeable power system comprises:

a removable rechargeable battery pack.

14. The bench system according to claim 12, wherein the rechargeable power system is adapted to be recharged by an alternating current power source.

15. The bench system according to claim 12, wherein the rechargeable power system is adapted to be recharged by a direct current power source.

16. The bench system according to claim 1, further comprising:

a canopy located above the seat.

17. The bench system according to claim 16, wherein the canopy supports at least a portion of the lighting system.

18. The bench system according to claim 1, wherein the seat is a portion of a movable swing.

19. A method of lighting a bench, comprising the steps of:

providing a bench;

attaching a lighting system to the bench, wherein the lighting system provides illumination to exterior surfaces of the bench from a location exterior to the bench; and collecting solar energy and converting the solar energy into electrical energy for providing power to the lighting system.

20. The method of lighting a bench of claim 19, further comprising the step of:

providing a rechargeable power source.

* * * * *